US006915630B2

(12) United States Patent
Surnilla et al.

(10) Patent No.: US 6,915,630 B2
(45) Date of Patent: Jul. 12, 2005

(54) ENGINE CONTROL FOR A VEHICLE EQUIPPED WITH AN EMISSION CONTROL DEVICE

(75) Inventors: Gopichandra Surnilla, West Bloomfield, MI (US); Jeffrey Scott Hepburn, Birmingham, MI (US); John M. Roth, Grosse Ile, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 68 days.

(21) Appl. No.: 10/248,529

(22) Filed: Jan. 27, 2003

(65) Prior Publication Data

US 2004/0144085 A1 Jul. 29, 2004

(51) Int. Cl.[7] ..... F01N 3/00

(52) U.S. Cl. ..... 60/295; 60/274; 60/285; 60/301

(58) Field of Search ..... 60/274, 285, 295, 60/301

(56) References Cited

U.S. PATENT DOCUMENTS

| | | | | |
|---|---|---|---|---|
| 5,483,795 | A | 1/1996 | Katoh et al. | |
| 5,953,907 | A * | 9/1999 | Kato et al. | 60/274 |
| 5,996,337 | A * | 12/1999 | Blosser et al. | 60/274 |
| 6,349,700 | B1 | 2/2002 | Buckland et al. | |
| 6,502,388 | B2 * | 1/2003 | Takaku et al. | 60/285 |
| 6,694,724 | B2 * | 2/2004 | Tanaka et al. | 60/274 |
| 6,698,188 | B2 * | 3/2004 | Irisawa et al. | 60/285 |

FOREIGN PATENT DOCUMENTS

| | | |
|---|---|---|
| EP | 0598917 B1 | 9/1999 |
| GB | 1480682 | 7/1975 |

* cited by examiner

*Primary Examiner*—Thomas Denion
*Assistant Examiner*—Diem Tran
(74) *Attorney, Agent, or Firm*—Allan J. Lippa; Alleman Hall McCoy Russell Tuttle LLP

(57) ABSTRACT

A method is described for operating an engine coupled to an emission control device that stores and reacts oxidants such as $NO_x$. The method transitions from lean to stoichiometric or rich operation under various conditions. For example, a periodic transition is performed with an amount of $NO_x$ stored in the device reaches a threshold, or when a tip-in from idle conditions has been identified.

20 Claims, 11 Drawing Sheets

SET POINT = tp_gram / mile * K
EXAMPLE OF VEHICLE ACTIVITY => POWER, FILTERED POWER, VEHICLE ENERGY, . . .

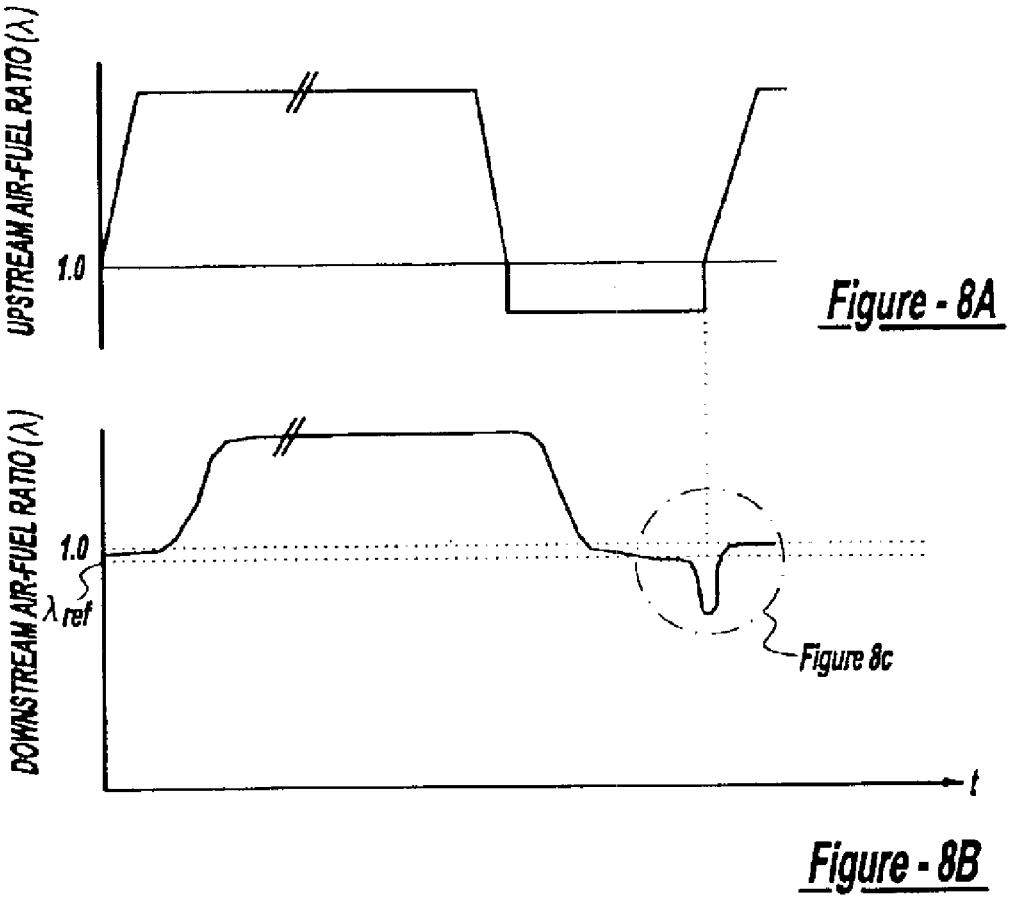
Figure - 8A
Figure - 8B
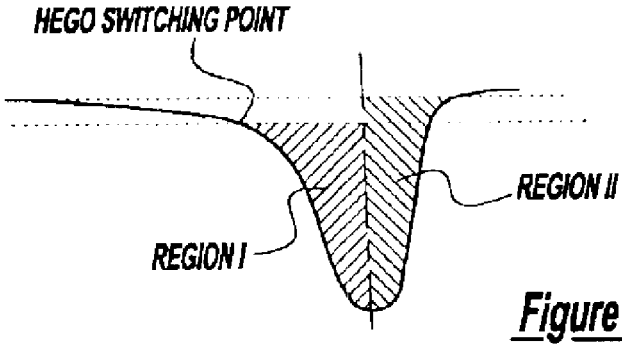
Figure - 8C

ENGINE CONTROL FOR A VEHICLE EQUIPPED WITH AN EMISSION CONTROL DEVICE

BACKGROUND OF INVENTION

1. Field of the Invention

The field of the invention relates generally to lean burn engine control, and more specifically to determining when to terminate lean operation.

2. Background of the Invention

Lean burn operating engines utilize emission control devices coupled to the engine to store $NO_x$ while operating lean, and then to reduce stored $NO_x$ when the engine operates rich.

The determination of when to operate the engine rich and terminate the lean combustion can be based on various methods. In one approach, described in EP 598917, the amount $NO_x$ stored in the device is estimated based on the amount of $NO_x$ generated in the engine. When this estimate of $NO_x$ stored reaches a predetermined value, the engine is transitioned from lean to rich.

Another approach is described in Katoh et al. (U.S. Pat. No. 5,483,795) where the amount of $NO_x$ per mile exiting the tailpipe is used to end lean operation and transition to rich.

The inventors of the present invention have recognized a disadvantage with such approaches in certain situations. In particular, if solely conditions in or downstream of the catalyst are utilized, certain situations can cause excessive $NO_x$ emissions since these set points are de-coupled from engine operation. For example, the inventors herein have recognized that during a tip-in operation from idle conditions, a high $NO_x$ and higher space velocity flow is generated. At a relatively low vehicle speed, even a relatively empty $NO_x$ trap can still emit a large tailpipe $NO_x$ spike under such high $NO_x$ and space velocity conditions.

SUMMARY OF INVENTION

The above disadvantages are overcome by a method for controlling an engine coupled an emission control device. The method comprises: operating lean; determining a first criteria for ending lean operation and transitioning to stoichiometric or rich operation, said first criteria based at least on an operating condition; determining a second criteria for ending lean operation and transitioning to stoichiometric or rich operation, said second criteria based at least on an increase in an engine amount; and transitioning to stoichiometric or rich for a period to purge stored $NO_x$ in response to said second criteria even if said first criteria has not been met, and then returning to lean operation.

In one particular example, the present invention detects an increase in engine output by determining whether there has been a tip-in from idle conditions. In this case, even if the $NO_x$ trap is relatively empty of stored $NO_x$, or if the current grams/mile of emitted $NO_x$ is well below the set-point, the engine performs a rich $NO_x$ purge. This allows a $NO_x$ purge when the feed gas $NO_x$ and engine load are high. This is beneficial because emission control device efficiency for $NO_x$ storage is typically low at high space velocities resulting from high loads.

Further, the rich operation gives a quick torque response and performs the $NO_x$ purge quickly. Furthermore, this quick torque response gives good customer satisfaction from an idle tip-in since the necessary air to burn the fuel is already present in the cylinder due to the lean operation. In other words, there is no manifold filling delay, which would be present if a desired lean air/fuel ratio is maintained during the tip-in.

An advantage of the present invention is that improved fuel economy can be achieved as well as more accurate engine idle speed control.

Note that there are various ways to determine first and second criteria according to the present invention. These can include, for example, an increase in pedal position, an increase in desired wheel torque, an increase in engine airflow or space velocity, a rate of change of pedal position, or various other parameters indicating an increase in engine output. Also note that various methods can be used to generate the first criteria such as estimating when an amount of $NO_x$ stored in the emission control device reaches a threshold value, measuring or estimating when an amount of $NO_x$ exiting the emission control device reaches a threshold, and even adjusting the thresholds depending on operating conditions such as exhaust temperature or time since engine start.

BRIEF DESCRIPTION OF DRAWINGS

FIGS. 8A–C illustrate operation according to the present invention; and

DETAILED DESCRIPTION

Figure 1:
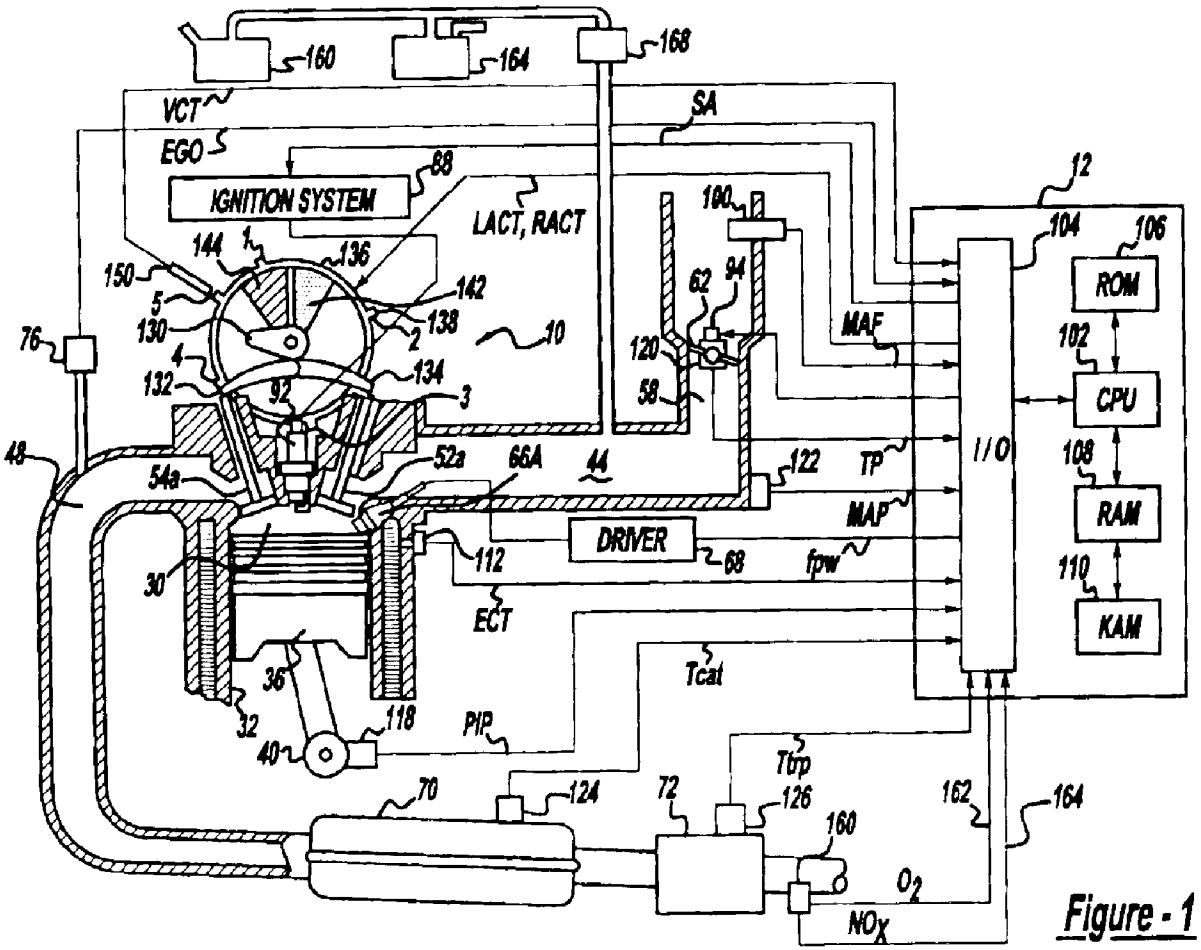
FIGS. 1 and 2 show a partial engine view.
Figure 2:
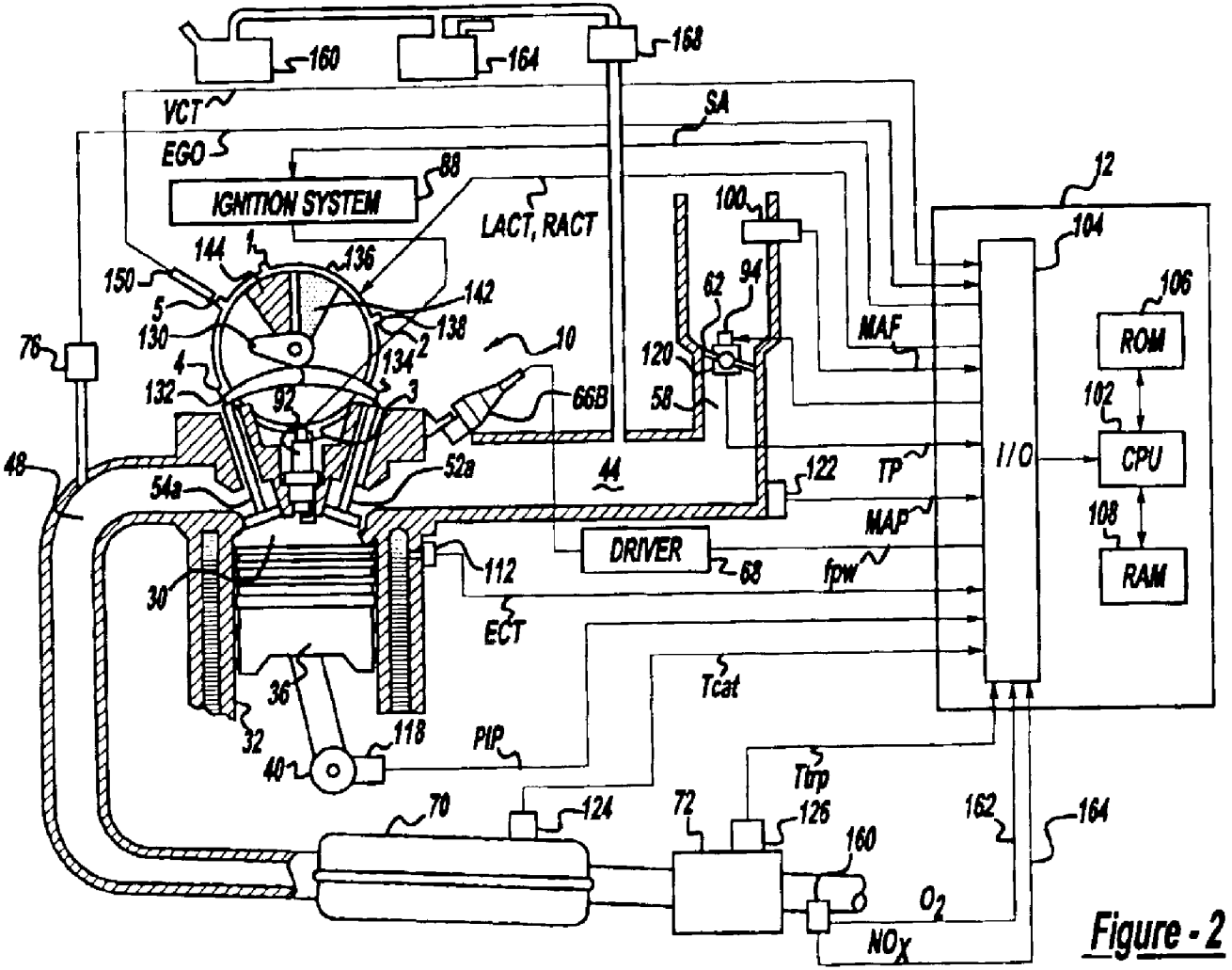

FIGS. 1 and 2 show one cylinder of a multi-cylinder engine as well as the intake and exhaust path connected to that cylinder.

Continuing with FIG. 1, direct injection spark ignited internal combustion engine 10, comprising a plurality of combustion chambers, is controlled by electronic engine controller 12. Combustion chamber 30 of engine 10 is shown including combustion chamber walls 32 with piston 36 positioned therein and connected to crankshaft 40. A starter motor (not shown) is coupled to crankshaft 40 via a flywheel (not shown). In this particular example, piston 36 includes a recess or bowl (not shown) to help in forming stratified charges of air and fuel. Combustion chamber, or cylinder, 30 is shown communicating with intake manifold 44 and exhaust manifold 48 via respective intake valves 52*a* and 52*b* (not shown), and exhaust valves 54*a* and 54*b* (not shown). Fuel injector 66A is shown directly coupled to combustion chamber 30 for delivering injected fuel directly therein in proportion to the pulse width of signal fpw received from controller 12 via conventional electronic driver 68. Fuel is delivered to fuel injector 66A by a conventional high-pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas sensor 76 is shown coupled to exhaust manifold 48 upstream of catalytic converter 70 (note that sensor 76 corresponds to various different sensors, depending on the exhaust configuration. For example, it could be a HEGO sensor, a UEGO sensor, or the like. I.e., Sensor 76 may be any of many known sensors for providing an indication of exhaust gas air/fuel ratio such as a linear oxygen sensor, a two-state oxygen sensor, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 66A during the engine compression stroke so that fuel is sprayed directly into the bowl of piston 36.

Stratified air/fuel layers are thereby formed. The strata closest to the spark plug contain a stoichiometric mixture, or a mixture slightly rich of stoichiometry, and subsequent strata contain progressively leaner mixtures. During the homogeneous mode, controller 12 activates fuel injector 66A during the intake stroke so that a substantially homogeneous air/fuel mixture is formed when ignition power is supplied to spark plug 92 by ignition system 88. Controller 12 controls the amount of fuel delivered by fuel injector 66A so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel being a function of the amount of fuel delivered to combustion chamber 30. An additional split mode of operation wherein additional fuel is injected during the exhaust stroke while operating in the stratified mode is also possible.

Nitrogen oxide ($NO_x$) adsorbent or trap 72 is shown positioned downstream of catalytic converter 70. $NO_x$ trap 72 is a three-way catalyst that absorbs $NO_x$ when engine 10 is operating lean of stoichiometry. The absorbed $NO_x$ is subsequently reacted with HC and CO and catalyzed when controller 12 causes engine 10 to operate in either a rich homogeneous mode or a near stoichiometric homogeneous mode.

Such operation occurs during a $NO_x$ purge cycle when it is desired to purge stored $NO_x$ from $NO_x$ trap 72, or during a vapor purge cycle to recover fuel vapors from fuel tank 160 and fuel vapor storage canister 164 via purge control valve 168, or during operating modes requiring more engine power, or during operation modes regulating temperature of the omission control devices such as catalyst 70 or $NO_x$ trap 72.

Controller 12 is shown in FIG. 1 as a conventional microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder.

In a preferred aspect of the present invention, sensor 118, which is also used as an engine speed sensor, produces a predetermined number of equally spaced pulses every revolution of the crankshaft.

In this particular example, temperature Tcat of catalytic converter 70 and temperature Ttrp of NOx trap 72 are inferred from engine operation.

In an alternate embodiment, temperature Tcat is provided by temperature sensor 124 and temperature Ttrp is provided by temperature sensor 126.

Continuing with FIG. 1, camshaft 130 of engine 10 is shown communicating with rocker arms 132 and 134 for actuating intake valves 52*a*, 52*b* and exhaust valve 54*a*, 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling as will be described later herein, the relative position of camshaft 130 to crankshaft 40 can be varied by hydraulic pressures in advance chamber 142 and retard chamber 144. By allowing high-pressure hydraulic fluid to enter advance chamber 142, the relative relationship between camshaft 130 and crankshaft 40 is advanced. Thus, intake valves 52*a*, 52*b*, and exhaust valves 54*a*, 54*b*, open and close at a time earlier than normal relative to crankshaft 40. Similarly, by allowing high-pressure hydraulic fluid to enter retard chamber 144, the relative relationship between camshaft 130 and crankshaft 40 is retarded. Thus, intake valves 52*a*, 52*b*, and exhaust valves 54*a*, 54*b*, open and close at a time later than normal relative to crankshaft 40.

Teeth 138, being coupled to housing 136 and camshaft 130, allow for measurement of relative cam position via cam timing sensor 150 providing signal VCT to controller 12.

Teeth 1, 2, 3, and 4 are preferably used for measurement of cam timing and are equally spaced (for example, in a V-8 dual bank engine, spaced 90 degrees apart from one another) while tooth 5 is preferably used for cylinder identification, as described later herein. In addition, controller 12 sends control signals (LACT, RACT) to conventional solenoid valves (not shown) to control the flow of hydraulic fluid either into advance chamber 142, retard chamber 144, or neither.

Relative cam timing is measured using the method described in U.S. Pat. No. 5,548,995, which is incorporated herein by reference. In general terms, the time, or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Sensor 160 provides an indication of both oxygen concentration in the exhaust gas as well as $NO_x$ concentration. Signal 162 provides controller a voltage indicative of the O2 concentration while signal 164 provides a voltage indicative of $NO_x$ concentration.

As described above, FIG. 1 (and FIG. 2) merely shows one cylinder of a multi-cylinder engine, and that each cylinder has its own set of intake/exhaust valves, fuel injectors, spark plugs, etc.

Referring now to FIG. 2, a port fuel injection configuration is shown where fuel injector 66B is coupled to intake manifold 44, rather than directly cylinder 30.

Also, in each embodiment of the present invention, the engine is coupled to a starter motor (not shown) for starting the engine. The starter motor is powered when the driver turns a key in the ignition switch on the steering column, for example. The starter is disengaged after engine start as evidence, for example, by engine 10 reaching a predetermined speed after a predetermined time. Further, in each embodiment, an exhaust gas recirculation (EGR) System routes a desired portion of exhaust gas from exhaust manifold 48 to intake manifold 44 via an EGR valve (not shown). Alternatively, a portion of combustion gases may be retained in the combustion chambers by controlling exhaust valve timing.

The engine 10 operates in various modes, including lean operation, rich operation, and "near stoichiometric" operation. "Near stoichiometric" operation refers to oscillatory operation around the stoichiometric air/fuel ratio. Typically, this oscillatory operation is governed by feedback from exhaust gas oxygen sensors. In this near stoichiometric operating mode, the engine is operated within one air/fuel ratio of the stoichiometric air/fuel ratio.

Feedback air/fuel ratio is used for providing the near stoichiometric operation. Further, feedback from exhaust gas oxygen sensors can be used for controlling air/fuel ratio during lean and during rich operation. In particular, a switching type, heated exhaust gas oxygen sensor (HEGO) can be used for stoichiometric air/fuel ratio control by controlling fuel injected (or additional air via throttle or VCT) based on feedback from the HEGO sensor and the desired air/fuel ratio. Further, a UEGO sensor (which provides a substantially linear output versus exhaust air/fuel ratio) can be used for controlling air/fuel ratio during lean, rich, and stoichiometric operation. In this case, fuel injection (or additional air via throttle or VCT) is adjusted based on a desired air/fuel ratio and the air/fuel ratio from the sensor. Further still, individual cylinder air/fuel ratio control could be used if desired.

Also note that various methods can be used according to the present invention to maintain the desired torque such as, for example, adjusting ignition timing, throttle position, variable cam timing position, and exhaust gas recirculation amount. Further, these variables can be individually adjusted for each cylinder to maintain cylinder balance among all the cylinder groups.

Figure 3:
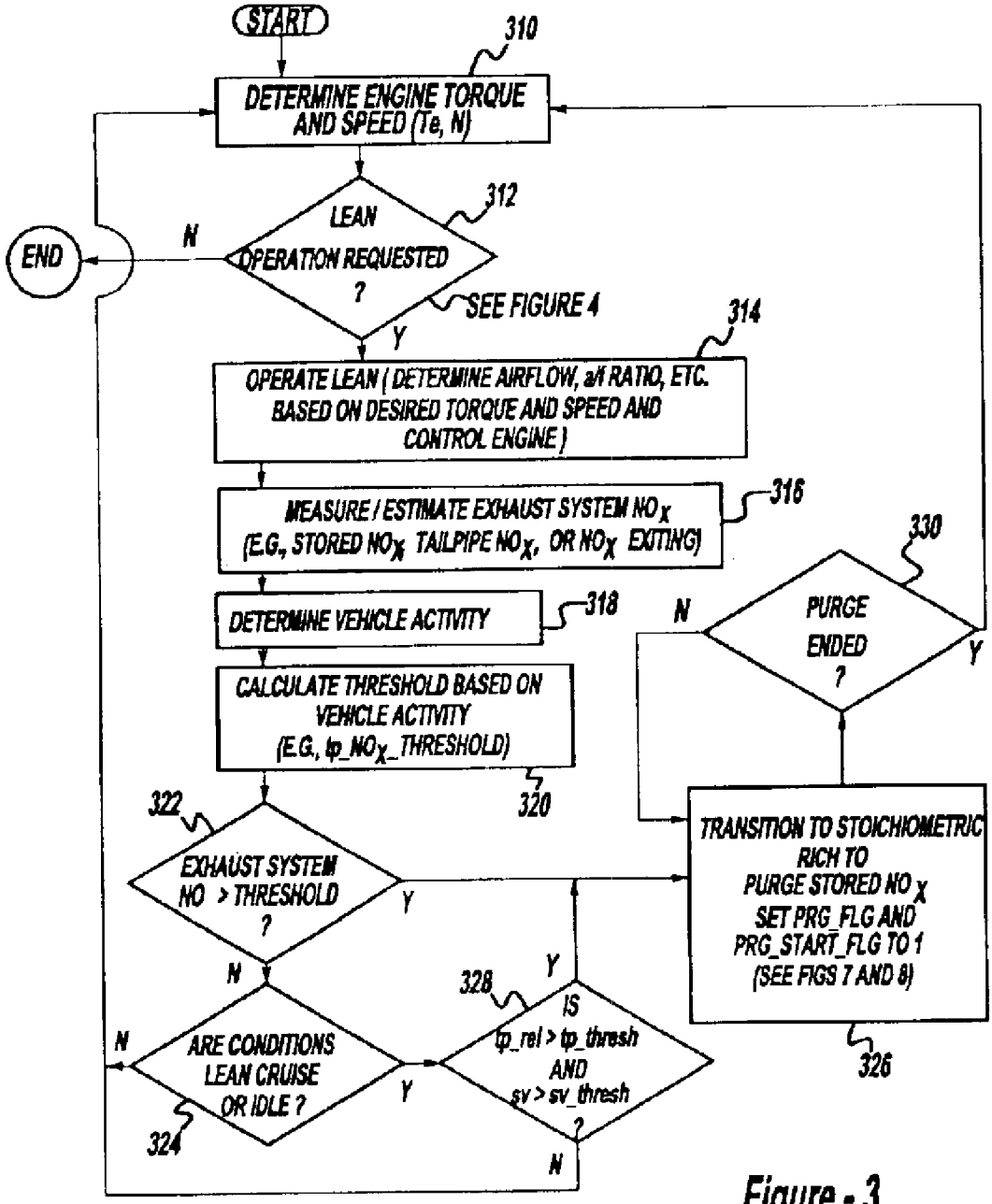
FIGS. 3 and 8 show a high level flow chart according to the present invention.

Referring now to FIG. 3, a routine is described for controlling lean engine operation and performing $NO_x$ purges. As referred to herein, a $NO_x$ purge refers to rich or stoichiometric exhaust gases passing to the emission control devices so that previously stored $NO_x$ in the emission control devices is reduced.

First, in step 310, the routine determines the engine torque and engine speed (Te, N). In one example, the routine determines the desired engine torque based on a requested power train torque. The requested power train torque is in turn generated based on the driver pedal position (PP) and vehicle speed. The engine speed is determined based on the engine speed sensor. Note that various other approaches could be used according to the present invention. For example, the actual engine speed and engine torque could be utilized. Further, the routine could determine a desired engine power and actual engine speed, or could utilize a desired wheel torque.

Next, in step 312, the routine determines whether lean operation is requested. This determination is based on the determined desired engine torque and engine speed in step 310. In particular, as described below herein with respect to FIG. 4, the desired engine mode varies between a lean mode, a stoichiometric mode, and a rich mode. As described with regard to FIG. 4, typically the lean operating mode is requested at low to mid-engine speed and engine torques. At higher engine speed and engine torques, stoichiometric operation is utilized. When the routine determines in step 312 that the lean operating mode is requested, the routine continues to step 314.

Figure 5:
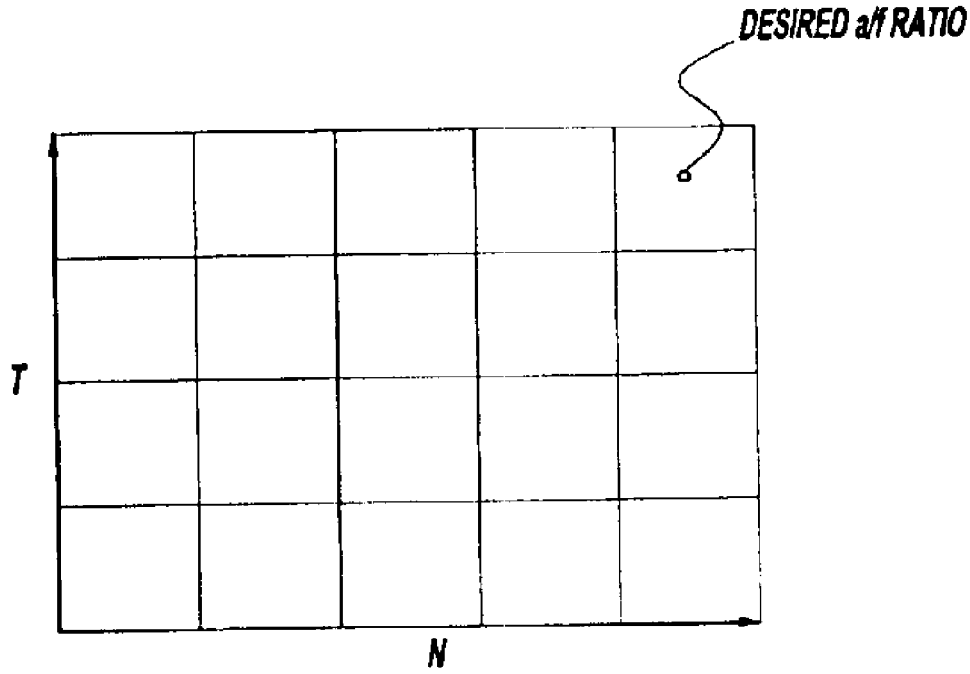
FIG. 5 shows a table of data used in controlling engine air/fuel ratio.

In step 314, the routine operates the engine in the lean operating mode. In this mode, the routine determines the engine operating values, such as, for example, air flow, air/fuel ratio, ignition timing, etc., based on the desired torque and speed from step 310. As an example, FIG. 5 illustrates a desired air/fuel ratio value determined based on engine torque and engine speed. Further, in step 314, the routine controls the engine actuators, such as fuel injectors, ignition timing actuators, throttle, etc., to achieve the desired values. Then, in step 316, the routine measures or estimates the exhaust system $NO_x$. In one example, the routine determines an estimate of the amount of $NO_x$ stored in the emission control device ($\Sigma NO_x$). In another example, the routine determines the amount of tailpipe $NO_x$ from the $NO_x$ sensor. In yet another example, the routine can estimate the amount of $NO_x$ exiting the emission control device based on the amount of stored $NO_x$ and engine operating conditions, such as the catalyst storage efficiency and the amount of $NO_x$ entering the catalyst.

Figure 6:
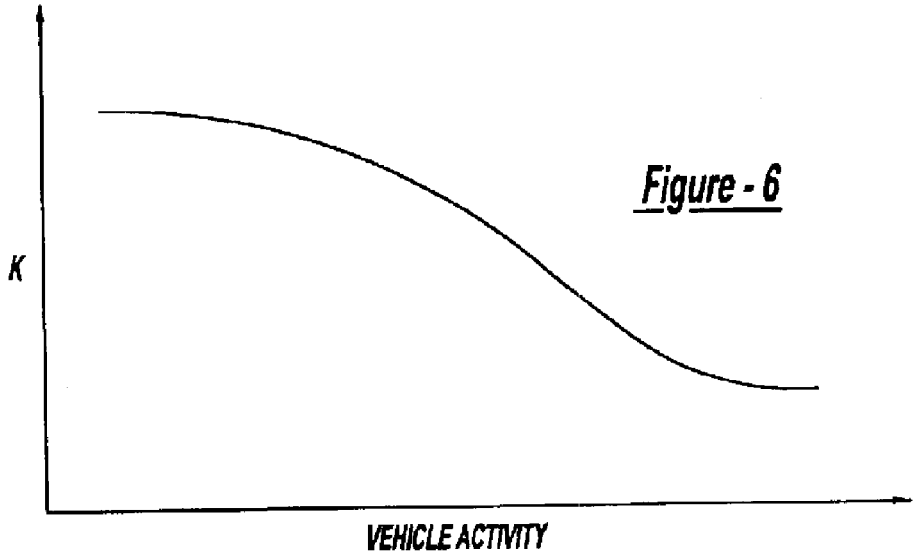
FIG. 6 shows a graph of a parameter used to control the engine.

Continuing with FIG. 3, in step 318 the routine determines vehicle activity as described herein with respect to FIG. 6. Next, the routine calculates a threshold based on the vehicle activity in step 320. The threshold calculated in step 320 is matched to the system parameter utilized in step 316. For example, if the exhaust system $NO_x$ values in step 316 is amount of $NO_x$ stored in the emission control device, then the threshold in step 320 is a threshold amount of $NO_x$ stored in the emission control device. Alternatively, if in step 316 the routine determined an actual amount of tailpipe $NO_x$ per distance traveled by the vehicle, the threshold in step 320 would be a threshold amount of tailpipe $NO_x$ per distance traveled by the vehicle.

Then, in step 322, the routine determines whether the exhaust system $NO_x$ is greater than the threshold determined in step 320. When the answer to step 322 is no, the routine continues to step 324. In step 324, the routine determines whether the conditions that the vehicle is currently operating in are either a lean cruise condition, or a lean idle condition. A lean cruise condition is, for example, when the vehicle is operating lean and vehicle speed is substantially held at a desired vehicle speed. Similarly, a lean idle condition is when the engine is operating lean and the vehicle is in the idle mode. The idle mode can be determined in various ways such as, for example, whether vehicle speed is below a threshold value and the driver pedal position (PP) is less than a pre-selected amount. When the answer to step 324 is no, the routine returns to step 310 and the routine repeats.

When the answer to step 322 is yes, the routine continues to step 326. In step 326, the routine transitions the engine, for a period, to the stoichiometric or rich operation to purge stored $NO_x$. Thus, in step 322, the controller determines that the "filling", or lean, portion of a lean-burn fill/purge cycle is to be ended and initiates a purge event by setting suitable purge event flags PRG_FLG and PRG_START_FLG to logical one.

This purge operation is described more fully with regard to FIGS. 7 and 8 described below herein. Generally, the transition to stoichiometric or rich occurs for a period to reduce the $NO_x$ stored in the emission control device. Note that the purge period can be stoichiometric, rich, or some combination of the two. This is described in various forms with regard to FIG. 7.

Continuing with FIG. 3, when the answer to step 324 is yes, the routine continues to step 328. Step 328 determines whether the relative throttle position (TP_REL) is greater than a throttle position threshold and whether the exhaust gas space velocity (SV) is greater than a second threshold. In other words, the routine determines whether there has been an increase in engine output that could cause a large amount of $NO_x$ to break through the catalyst. This phenomenon is described more fully with regard to FIG. 9 described below herein. When the answer to step 328 is no, the routine returns to step 310 and repeats. However, when the answer to step 328 is yes, the routine continues to step 326 and performs a $NO_x$ purge.

In alternative embodiments, the determination at step 328 can be executed in various different ways. In one example, the routine can request a purge to be initiated based on whether space velocity, or engine airflow, or engine output, increases by greater than a predetermined amount, where the predetermined amount can be adjusted based on various operating conditions such as exhaust temperature. As one specific example, a purge can be initiated when the change in pedal position reaches a threshold, or where the rate of change of pedal position (over time, or over engine events) reaches a predetermined threshold, irrespective of space velocity. As another specific example, a purge can be initiated when engine airflow reaches a threshold value, or when space velocity reaches a threshold value, irrespective of pedal position.

From step 326, the routine continues to step 330. In step 330, the routine determines whether the purge control has ended. When the answer to step 330 is no, the routine returns to step 326. However, when the answer to step 330 is yes, the routine returns to step 310.

In this way, during lean operation, the routine utilizes at least two criteria for determining whether to end lean operation and transition to a stoichiometric or rich operation. The first criteria is based on, in this example, exhaust system $NO_x$ such an amount of $NO_x$ stored in the emission control device, or an amount of $NO_x$ exiting the tailpipe per distance traveled by the vehicle. The second criteria is based on an increase in an engine amount. In one example, this is an increase such as an increase in an engine airflow, engine torque, or engine cylinder charge. In another example, this is an increase in throttle position as well as exhaust gas space velocity. Each of these criteria can be used, as described above, to determine when to end lean operation and transition, for a period, to stoichiometric or rich operation before returning to lean operation as requested by the desired engine torque and engine speed. In this way, it is possible to provide adequate control of transient $NO_x$ spikes, while also obtaining increase fuel economy, without using larger or more expensive catalysts.

In other words, if the end of lean operation was triggered by an estimate of $NO_x$ stored, as opposed to the method of the present invention, a larger catalyst can be needed to meet emission requirements in the presence of the transient (e.g., tip-in) $NO_x$ spikes.

Also note that simply relying on enrichment due to high speed/high load conditions is insufficient to solve the disadvantages with prior approaches, since a $NO_x$ spike typically occurs when the driver transitions from requesting low torque to a higher level of torque, but one that is still in the region where lean operation is desired. In other words, the present invention provides temporary rich in a region that would otherwise be in a region where lean operation is requested. This is described more fully with respect to FIGS. 10–12, and specifically with respect to the line 1010*a* of FIG. 10. Further, it is also described below with respect to FIG. 4.

Figure 4:
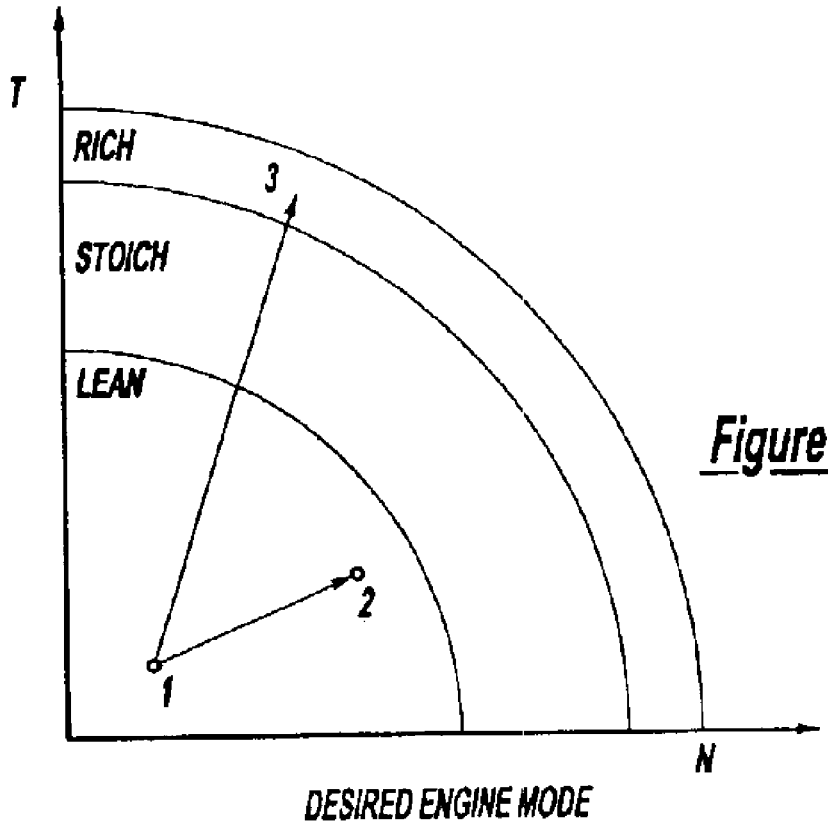
FIG. 4 shows a graph illustrating operation according to the present invention.

Referring now to FIG. 4, a graph illustrating a desired engine mode as a function of engine torque and engine speed is illustrated. The graph illustrates three modes: a lean mode, a stoichiometric mode, and a rich mode. To illustrate engine operation according to FIG. 4, three points are shown on the graph (1, 2, 3). When the engine is at point 1, the desired engine mode is lean operation. Thus, at point 1, the engine operates lean with periodic transitions to stoichiometric or rich to purge stored $NO_x$ based on an amount of $NO_x$ stored, $NO_x$ emissions per distance traveled, or another $NO_x$ emissions threshold.

However, a transition to purge the $NO_x$ stored in the emission control device can also be triggered by a transition from point 1 to point 2 (e.g., a rapid transition from point 1 to 2). Thus, at point 2, the desired operating mode is still a lean operating mode; however, since desired engine output may have increased past a threshold, the engine is temporarily made stoichiometric or rich to prevent a $NO_x$ spike from passing through the exhaust system. Further, this case from point 1 to 2 is to be contrasted against the case when the engine transitions from point 1 to 3. At point 3, the engine is to be operated in a rich operating mode. This mode is distinct from a temporary $NO_x$ purge, since in point 3 the engine is continuously operated rich to meet the requested torque demand. Thus, when transitioning from point 1 to 3, the engine is also transitioned from lean to rich, however, the engine is maintained rich while at point 3 until the driver requests a torque in either the stoichiometric or lean zone.

Referring now to FIG. 5, a table is illustrated showing how the desired air/fuel ratio is scheduled versus speed and torque. Note, however, that this is simply one embodiment and various other approaches can be used. For example, the desired air/fuel ratio can be scheduled versus speed and load, vehicle speed and wheel torque, speed and engine power, or other such variables.

FIG. 6 shows how the parameter K varies with vehicle activity. In one example, vehicle activity is determined by filtering vehicle power. Another example of vehicle activity could be engine speed or vehicle speed changes over time.

The parameter K is then used to modify the set-point value used to determine when to end lean operation and temporarily transition to stoichiometric or rich to purge the stored $NO_x$. In one example, the set point is calculated as a tail pipe grams/mile times K. In another example, the set-point amount of $NO_x$ stored in the emission control device is multiplied by K.

Figure 7:
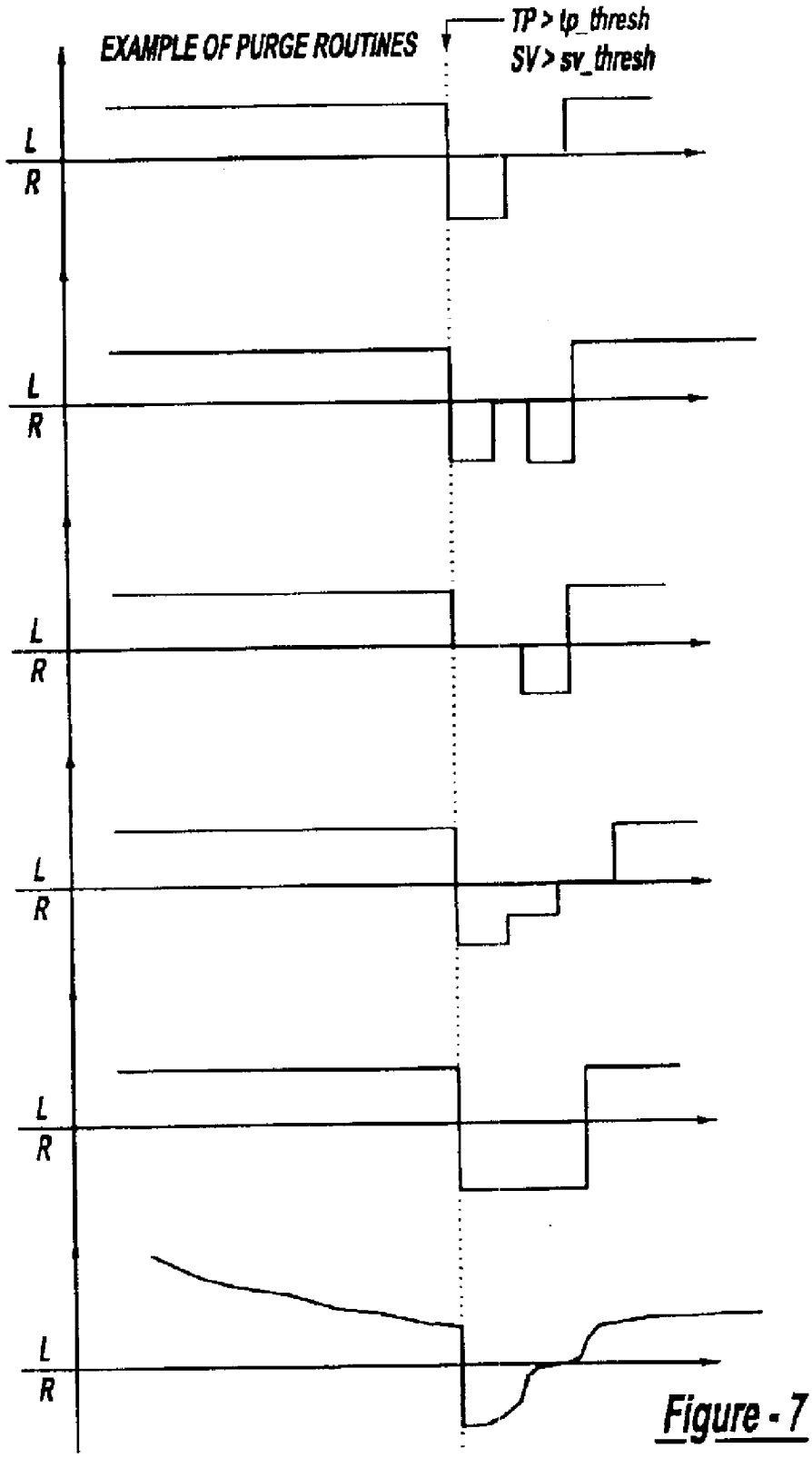
FIG. 7 shows various examples of rich purging strategies.

Referring now to FIG. 7, 6 graphs are shown illustrating various different forms of purge cycles that can be used according to the present invention. Note that these are merely examples of the form of purging that can be used, and any other similar type of temporary rich or stoichiometric operation could be used.

To the extent that the emission control device(s) is to be purged of stored $NO_x$ to rejuvenate the ability to store $NO_x$ and thereby permit further lean-burn operation as circumstances warrant, the controller schedules a purge event (rich operation) when requested either based on an increase in engine output (e.g., tip-in), or based on an amount of $NO_x$ in the exhaust system (e.g., $\Sigma NO_x$ stored, or tailpipe $NO_x$ per distance traveled by the vehicle).

Upon the scheduling of such rich operation, (in this case temporary rich operation before return to the requested lean operation based on speed and torque), the controller determines a suitable rich air/fuel ratio as a function of current engine operating conditions, e.g., sensed values for air mass flow rate, temperature of the emission control device, or other such parameters. By way of example, in an exemplary embodiment, the determined rich air/fuel ratio for purging the device of stored $NO_x$ typically ranges from about 0.65 for "low-speed" operating conditions to perhaps 0.75 or more for "high-speed" operating conditions. The controller maintains the determined air/fuel ratio (based on feedback from upstream air/fuel sensors) until a predetermined amount of CO and/or HC has "broken through" the device. This threshold is indicated by the product of:

(1)the measured downstream oxygen concentration, or air/fuel ratio generated by a downstream air/fuel, or other such sensor; and (2)the output signal AM generated by the mass air flow sensor.

In one example, the dual output downstream sensor can be used to provide the downstream oxygen concentration.

Figure 8:
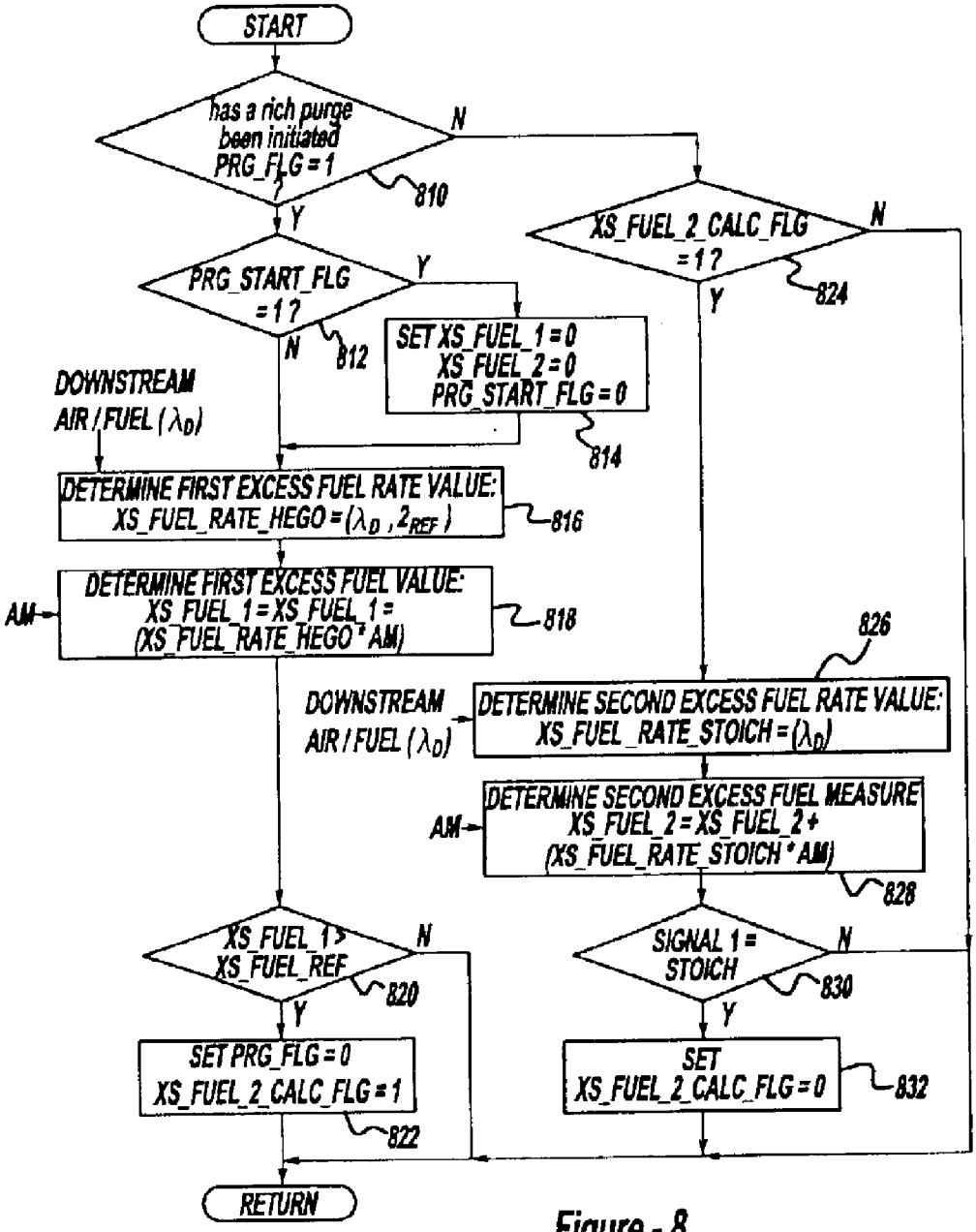

More specifically, as illustrated in the flow chart appearing as FIG. 8 and the plots illustrated in FIGS. 8A, 8B and 8C, during the purge event, after determining at step 810 that a purge event has been initiated (by checking whether PRG_FLG is equal to 1), the controller determines at step 812 whether the purge event has just begun by checking the status of the purge-start flag PRG_START_FLG. If the purge event has just begun, the controller resets certain registers (to be discussed individually below) to zero in step 814. The controller then determines a first excess fuel rate value XS_FUEL_RATE_HEGO at step 816, by which the downstream air/fuel ratio is "rich" of a first predetermined, slightly-rich threshold $\lambda_{ref}$ (the first threshold $\lambda_{ref}$ being exceeded shortly after a similarly-positioned HEGO sensor would have "switched". Note, however, that various other threshold levels could be used, such as approximately 0.98 relative air/fuel ratios).

The controller then determines a first excess fuel measure XS_FUEL_1 as by summing the product of the first excess fuel rate value XS_FUEL_RATE_HEGO and the current output signal AM generated by the mass airflow sensor 24 (at step 718). The resulting first excess fuel measure XS_FUEL_1, which represents the amount of excess fuel exiting the emission control device near the end of the purge event, is graphically illustrated as the cross-hatched area REGION I in FIG. 8C. When the controller determines at step 820 that the first excess fuel measure XS_FUEL_1 exceeds a predetermined excess fuel threshold XS_FUEL_REF, the trap 36 is deemed to have been substantially "purged" of stored $NO_x$, and the controllerthe rich (purging) operating condition at step 822 by resetting the purge flag PRG_FLG to logical zero. The controller further initializes a post-purge-event excess fuel determination by setting a suitable flag XS_FUEL_2_CALC to logical one.

Returning to steps 810 and 824 of FIG. 8, when the controller determines that the purge flag PRG_FLG is not equal to logical one and, further, that the post-purge-event excess fuel determination flag XS_FUEL_2_CALC is set to logical one, the controller begins to determine the amount of additional excess fuel already delivered to (and still remaining in) the exhaust system upstream of the emission control device as of the time that the purge event is discontinued.

Specifically, at steps 826 and 828, the controller starts determining a second excess fuel measure XS_FUEL_2 by summing the product of the difference XS_FUEL_RATE_STOICH by which the downstream air/fuel ratio is rich of stoichiometry, and summing the product of the difference XS_FUEL_RATE_STOICH and the mass air flow rate AM. The controller continues to sum the difference XS_FUEL_RATE_STOICH until the downstream air/fuel ratio from the downstream sensor indicates a stoichiometric value, at step 830 of FIG. 8, at which point the controller resets the post-purge-event excess fuel determination flag XS_FUEL_2_CALC to logical zero in step 832.

The resulting second excess fuel measure value XS_FUEL_2, representing the amount of excess fuel exiting the emission control device after the purge event is discontinued, is graphically illustrated as the cross-hatched area REGION II in Figure Preferably, the second excess fuel value XS_FUEL_2 in the KAM as a function of engine speed and load, for subsequent use by the controller in optimizing the purge event.

Figure 9:
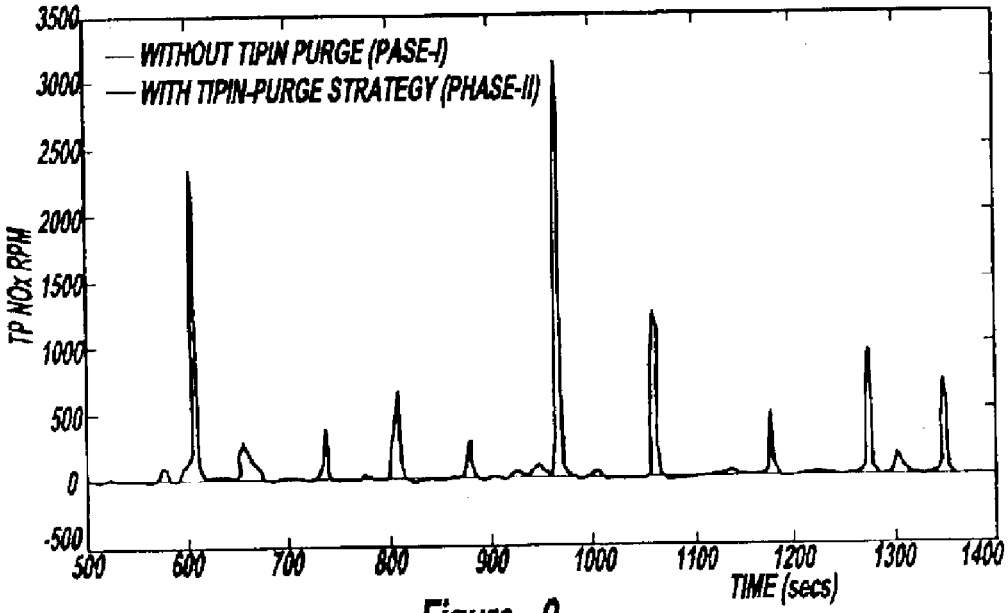
FIGS. 9–12 shows experimental results using the present invention to advantage.

FIG. 9 shows a graph illustrating a comparison of the present invention to a strategy that fails to initiate a purge cycle in response to an increase in engine output, such as in response to a pedal tip-in by the driver. The graph shows the significant decrease in $NO_x$ exiting the emission control device, which in this case is the tailpipe $NO_x$. FIG. 9 shows actual vehicle emissions data obtained from emission testing laboratories.

Note that, as described above herein, the transition to rich after a tip-in is detected enables a fast purge of the emission control device and also reduces the feed gas $NO_x$ due to rich operation as well as providing a good torque response to the driver.

Figure 10:
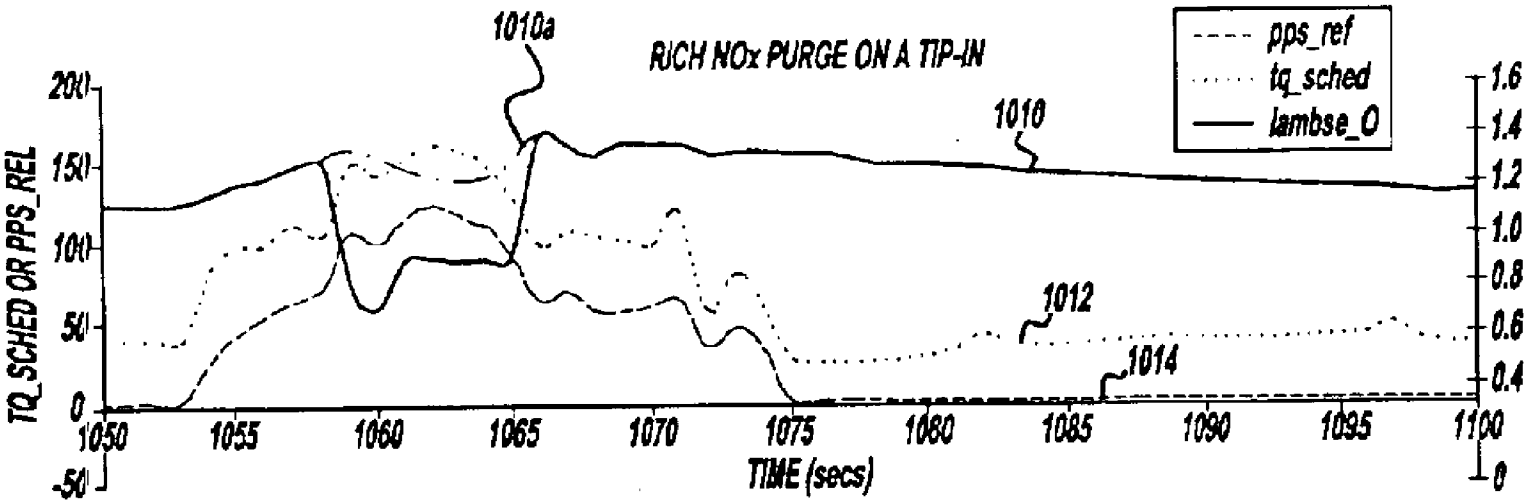
Figure 11:
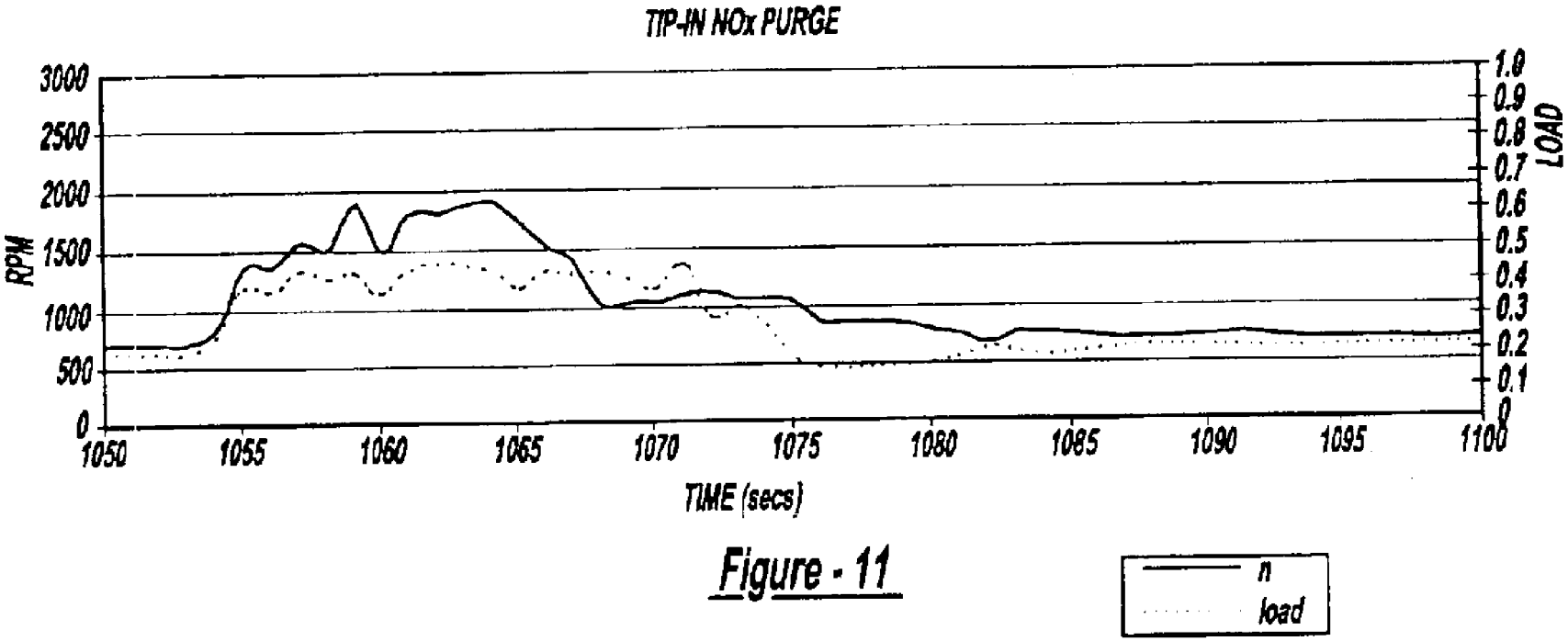
Figure 12:
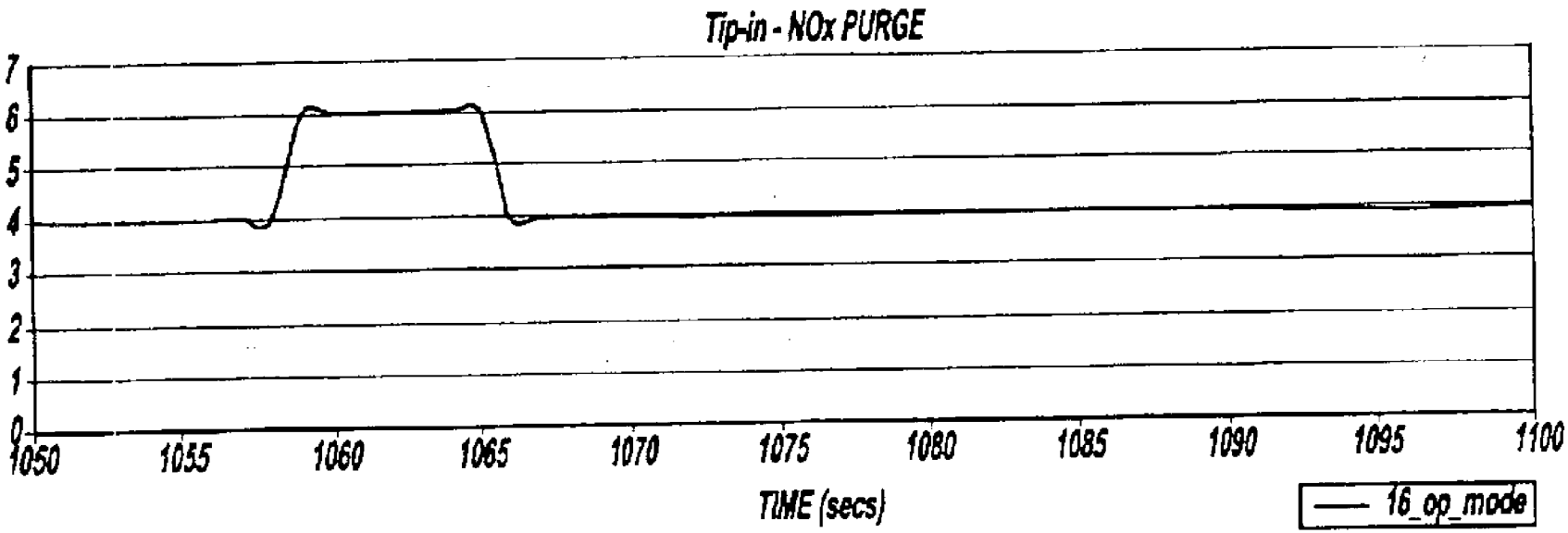

FIGS. 10–12 also show experimental test data for the present invention. In particular, FIG. 10 shows a situation where a tip-in occurs at approximately 1057 seconds. The air/fuel ratio desired is shown by the solid line 1010, desired torque is shown by the short dashed line 1014, and pedal position is shown by the long dashed line 1012. Operation in the convention manner would produce the desired lean air/fuel ratio indicated by dash dot line 1010*a*. However, even though the desired air/fuel ratio based on a speed-torque map (or other such map) would normally request lean operation during this entire section of operation, the present invention switched modes as shown in FIG. 12 from mode 4 to mode 6. This signals a $NO_x$ purge, as shown by the temporary rich air/fuel ratio in FIG. 10 from approximately 1057 seconds to 1066 seconds. FIG. 11 shows the corresponding engine load and engine speed.

In this way, when transitioning between regions (both of which are regions where lean operation is requested), the engine is temporarily made rich or stoichiometric to reduce $NO_x$ emissions, even though a purge of stored $NO_x$ may not be requested based on an estimate of $NO_x$ stored, or some other criteria.

This concludes the detailed description of the invention.

We claim:

1. A method for controlling an engine coupled to an emission control device, comprising:

operating lean;

determining a first criteria for ending lean operation and transitioning to stoichiometric or rich operation, said first criteria based at least on an operating condition;

determining a second criteria for ending lean operation and transitioning to stoichiometric or rich operation, said second criteria based at least on an increase in an engine amount from a lean idle condition where an operator request increases past a first threshold and a parameter indicative of engine airflow increases past a second threshold; and transitioning to stoichiometric or rich for a period to purge stored $NO_x$ in response to said second criteria, even if said first criteria has not been met, and then returning to lean operation.

2. The method recited in claim 1 wherein said operating condition is an amount of $NO_x$ stored in the emission control device.

3. The method recited in claim 1 wherein said operating condition is an amount of $NO_x$ exiting in the emission control device.

4. The method recited in claim 1 wherein said operating condition is an amount of $NO_x$ emitted per distance traveled.

5. The method recited in claim 1 wherein said determining said second criteria further comprises determining said second criteria for ending lean operation and transitioning to stoichiometric or rich operation based at least on an increase in desired engine output.

6. The method recited in claim 1 wherein said determining said second criteria further comprises determining said second criteria for ending lean operation and transitioning to stoichiometric or rich operation based at least on an increase in actual engine output.

7. The method recited in claim 1 wherein said parameter is an engine airflow.

8. The method recited in claim 1 wherein said parameter is flow space velocity.

9. The method recited in claim 1 wherein said operator request includes an increase in pedal position.

10. The method recited in claim 1 wherein said increase in said engine amount is an increase in engine torque.

11. A method for controlling an engine coupled an emission control device in an exhaust system, comprising:

operating lean, wherein said lean operation is a lean idle operation;

detecting an amount of $NO_x$ emission in the engine exhaust system;

determining whether an operator command and a flow space velocity are greater than respective first and second thresholds; and ending lean operation and transitioning to stoichiometric or rich operation in response to either said amount of $NO_x$ emissions or said determination.

12. The method recited in claim 11 wherein said amount of $NO_x$ emission in the engine exhaust system is an amount of $NO_x$ stored in the emission control device.

13. The method recited in claim 11 wherein said amount of $NO_x$ emission in the engine exhaust system is an amount of $NO_x$ exiting the emission control device.

14. The method recited in claim 11 wherein said amount of $NO_x$ emission in the engine exhaust system is an amount of $NO_x$ exiting a tailpipe of the exhaust system per distance traveled.

15. The method recited in claim 11 wherein said operator command is a pedal position.

16. The method recited in claim 11 further comprising returning to lean operation alter said stoichiometric or rich operation.

17. A method for controlling an engine coupled an emission control device, comprising:

operating the engine in a region where lean operation is requested;

determining a first criteria for ending lean operation and transitioning to stoichiometric or rich operation, said first criteria based at least on an operating condition;

determining a second criteria for ending lean operation and transitioning to stoichiometric or rich operation, said second criteria based at least on an increase in an engine amount where an operator request is greater than a first threshold and a parameter indicative of space velocity is greater than a second threshold; and while still operating in said region, transitioning to stoichiometric or rich for a period to purge stored $NO_x$ in response to at least one of said first and second criteria.

18. The method recited in claim 17 wherein said transitioning is performed in response to said second criteria even if said first criteria has not been met.

19. A system for an engine coupled an emission control device comprising:

a first sensor for indicating $NO_x$ amount;

a second sensor for indicating an engine air amount; and a controller for operating the engine lean during an idle, determining a first criteria for ending said lean idle operation and transitioning to stoichiometric or rich operation based at least on an increase in said first sensor, determining a second criteria for ending said lean idle operation and transitioning to stoichiometric or rich operation based at least on said second sensor indicating space velocity is greater than a first threshold and based on an operator request being greater than a second threshold, and transitioning to stoichiometric or rich for a period to purge stored $NO_x$ in response to said second criteria even if said first criteria has not been met, and then returning to lean operation.

20. A method for controlling an engine coupled to an emission control device that stores and releases $NO_x$, comprising:

operating with a lean air fuel ratio at least during an idle condition;

upon a first operating condition, ending said lean operation and transitioning to stoichiometric or rich operation and then returning to lean operation; and upon an increase in an engine air flow amount from said lean idle condition past a first threshold and an increase in an operator request past a second threshold, even when said first condition is not reached, transitioning to stoichiometric or rich operation and then returning to lean operation.

* * * * *